US007507089B2

(12) United States Patent
Jones et al.

(10) Patent No.: US 7,507,089 B2
(45) Date of Patent: Mar. 24, 2009

(54) METHODS AND APPARATUS TO PROVIDE TRAINING AGAINST IMPROVISED EXPLOSIVE DEVICES

(75) Inventors: Giles D. Jones, Chino Hills, CA (US); Quang K. Ha, Corona, CA (US); Lee L. Ourn, Loma Linda, CA (US); Saman Jannati, Diamond Bar, CA (US); Glenn D. Taylor, Tucson, AZ (US); David L. MacArthur, Seubersdorf (DE); Qingce Bian, Corona, CA (US)

(73) Assignee: Raytheon Company, Waltham, MA (US)

( * ) Notice: Subject to any disclaimer, the term of this patent is extended or adjusted under 35 U.S.C. 154(b) by 572 days.

(21) Appl. No.: 11/182,495

(22) Filed: Jul. 15, 2005

(65) Prior Publication Data

US 2007/0015115 A1 Jan. 18, 2007

(51) Int. Cl.
*F41A 33/00* (2006.01)

(52) U.S. Cl. ..... 434/11

(58) Field of Classification Search ..... 434/11, 434/16

See application file for complete search history.

(56) References Cited

U.S. PATENT DOCUMENTS

| | | | | |
|---|---|---|---|---|
| 4,014,262 | A * | 3/1977 | Betts | 102/335 |
| 5,235,127 | A | 8/1993 | Findley | |
| 5,326,268 | A * | 7/1994 | Campagnuolo | 434/15 |
| 5,474,452 | A | 12/1995 | Campagnuolo | |
| 5,481,979 | A * | 1/1996 | Walder | 102/498 |
| 6,065,404 | A | 5/2000 | Ripingill, Jr. et al. | |
| 6,386,879 | B1 | 5/2002 | Varshneya et al. | |
| 6,450,817 | B1 | 9/2002 | Deinlein | |
| 6,579,097 | B1 | 6/2003 | Sampson et al. | |
| 6,599,127 | B1 | 7/2003 | Hopmeier et al. | |
| 6,616,452 | B2 | 9/2003 | Clark et al. | |
| 6,814,667 | B2 | 11/2004 | Jeffway, Jr. et al. | |
| 7,001,182 | B2 | 2/2006 | Lazecki et al. | |
| 2004/0096806 | A1 | 5/2004 | Davidsson et al. | |

OTHER PUBLICATIONS

DefenseLINK News: Arrival Sets Tone for Civic Leader's Fort Bliss Visit, United States Department of Defense, Oct. 17, 2005, 4 pages.

M-72 Light Anti-tank Weapon (LAW), FAS Military Analysis Network, Dec. 20, 2005, 4 pages.

OSI Defense Systems, Our Products, Training Systems, Oct. 17, 2005, 7 pages.

Titan Dynamics Systems, Inc., Training the way you fight!, Rocket Propelled Grenade System (RPGS),Oct. 17, 2005, 1 page.

Simulation Projects, Shoulder Launched Munitions (SLM), 4 pages, Jul. 27, 2006, www.unitech1.com/solutions_sim_p2.htm.

(Continued)

*Primary Examiner*—Stephen M Johnson
(74) *Attorney, Agent, or Firm*—Daly, Crowley, Mofford & Durkee LLP

(57) ABSTRACT

Method and apparatus for a training system for improvised explosive devices (IEDs). An IED training system can include an inert explosive component that can resemble a large round, rocket propelled grenade (RPG), or the like. Various triggers can activate visual and/or audio devices in response to triggering the system, such as by a motion sensor or trainer action.

8 Claims, 18 Drawing Sheets

OTHER PUBLICATIONS

PEO STRI, One Team. Fight. Training Future, PEOSTRI Program Guide, www.military-training-technology.com/PDF/2006_PEO_STRI.PDF, 16 pages.

Improvised explosive device, Wikipedia, Jul. 2006, http://en.wikipedia.org/wiki/improvised_explosive_device.

Multiple Integrated Laser Engagement System Shoulder Launched Munitions (MILES SLM), Jul. 2006, www.peostri.army.mil/PRODUCTS/MILES_SLM/, 1 page.

PEO STRI Awards $18 Million Contract for the Multiple Integrated Laser Engagement Simulation (MILES) Shoulder Launched Munitions, Jul. 2006, www.peostri.army.mil/PAO/pressrelease/MILES_SLM.jsp, 1 page.

Military Training Technology, Online Edition, Replicating a Grim Reality, www.military-training.com/print_article.cfm?DocID=664, Jul. 2006, 4 pages.

* cited by examiner

METHODS AND APPARATUS TO PROVIDE TRAINING AGAINST IMPROVISED EXPLOSIVE DEVICES

CROSS REFERENCE TO RELATED APPLICATIONS

Not Applicable.

STATEMENT REGARDING FEDERALLY SPONSORED RESEARCH

Not Applicable.

BACKGROUND

As is well known in the art, Improvised Explosive Devices (IEDs) have been used by terrorists and others to kill and injure those in proximity to the device. Some IEDs include a device, such as a cell phone, that can be used to detonate the IED. As is also known in the art, IEDs can be difficult to locate and recognize. Different types of "camouflage" or "disguise" for IEDs, such as canvas bags to hide artillery rounds and other materials, can be found in various theaters of military operations. There are also a variety of different triggering methods currently utilized for IEDs, such as hard wired, Radio Frequency (RF) operated, and trip wired.

SUMMARY

The present invention provides a training system for an improvised explosive device (IED). The system can be used to train personnel to locate and recognize IEDs. The system can include an inert explosive component resembling an actual IED. The system can also include one or more of audio devices, visual devices, and pyrotechnic devices that can be activated when the system is triggered. The system can be triggered by sensors, such as motion sensors, trainer actions, and the like.

In one aspect of the invention, a training system for an improvised explosive device (IED) includes an inert explosive component configured to resemble a real improvised explosive device, an explosion simulation device coupled to the inert explosive component, and an interface device assembly coupled to the explosion simulation device that can be activated upon triggering of the system. The system can further include one or more of the following features: the explosion simulation device includes a canister to hold powder that can be discharged; the explosion simulation device includes a pyrotechnic device; an audio device coupled to the interface device assembly to make sound upon triggering of the system; a visual device coupled to the interface device assembly to generate visual effects upon triggering of the system; a trigger device coupled to the interface device assembly to enable a user to trigger the system; the trigger device includes a wired and/or wireless device; a motion sensor to trigger to the system; the interface device assembly is adapted to connect to one or more simulation systems, such as the Anti Tank Weapons Engagement Simulation System (ATWESS), the Main Gun System Simulator (MGSS), and the Direct Indirect Fire Cue (DIFCUE), for example.

In another aspect of the invention, an improvised explosive device (IED) training system includes an interface device assembly, a trigger input device to provide trigger inputs to the interface device assembly, at least one audio cue device receiving signals from the interface device assembly, at least one visual cue device receiving signals from the interface device assembly, and at least one external trigger device coupled to the interface device assembly. The system can further include one or more of the following features: an inert explosive component; the inert explosive component resembles a real IED; the inert explosive component includes a canister that can discharge powder; a pyrotechnic device coupled to the inert explosion component for activation upon triggering of the system; the input trigger device includes a motion sensor; the audio cue device includes a speaker;

In another aspect of the invention, a method includes initializing a training system for improvised explosive devices (IEDs) having an inert explosive component resembling a real IED, and activating one or more of an audio cue device, a visual cue device, and a pyrotechnic device upon triggering of the system. The method can further include one or more of: initializing a motion sensor that can trigger the system; receiving a signal from a user to trigger the system; and, the visual cue device includes a canister containing power under pressure that can be released.

BRIEF DESCRIPTION OF THE DRAWINGS

The exemplary embodiments contained herein will be more fully understood from the following detailed description taken in conjunction with the accompanying drawings, in which.

DETAILED DESCRIPTION

Figure 1:
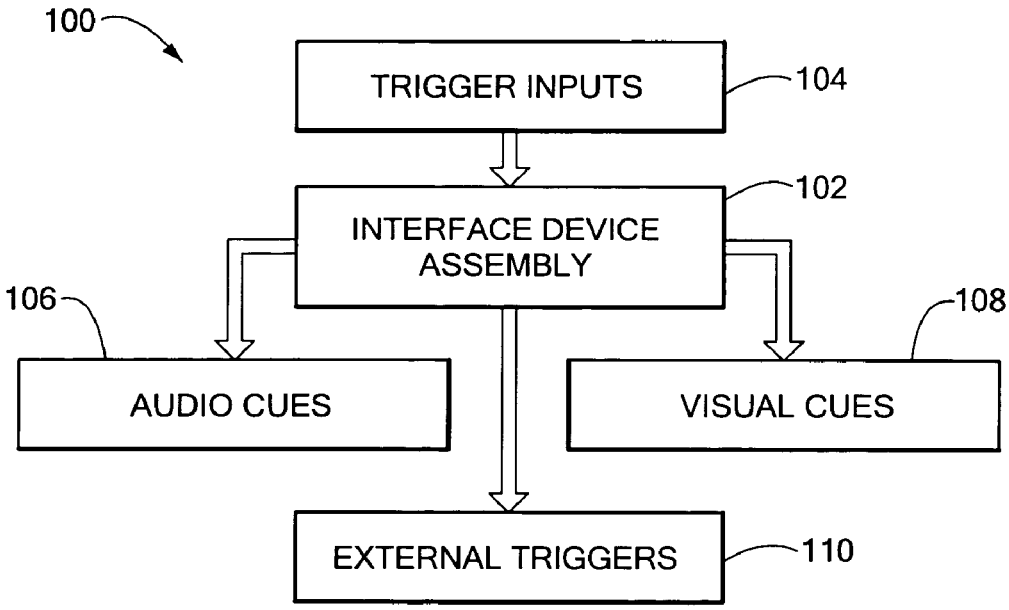
FIG. 1 is a block diagram of an exemplary training improvised explosive device (IED) in accordance with the present invention.

FIG. 1 shows a block diagram of an exemplary training Improvised Explosive Device (IED) 100 in accordance with the present invention. The training device 100 includes an interface device assembly 102 receiving signals from one or more trigger input devices 104 and providing signals to one or more audio cue devices 106, one or more visual cue devices 108, and one or more external trigger devices 110. In general, the IED training device simulates visual aspects of enemy IEDs, such as those currently found in Iraq. In one embodiment, explosive simulation is provided to a trainee through the use of audio and visual clues.

Figure 2A:
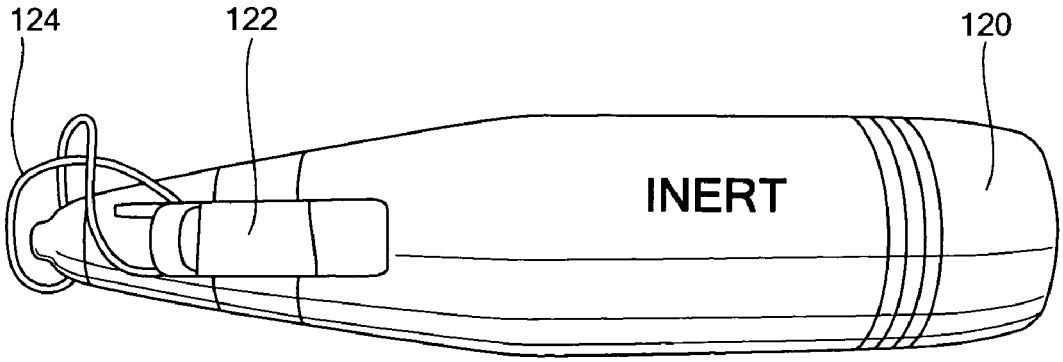
FIG. 2A is a pictorial representation of an inert explosive component resembling a 105 mm round IED.
Figure 2B:
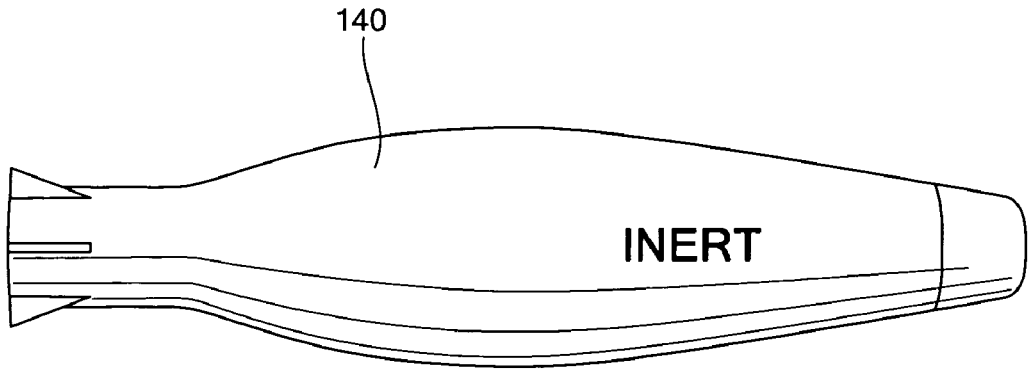
FIG. 2B is a pictorial representation of an inert explosive component resembling a rocket propelled grenade (RPG)

FIGS. 2A and 2B show, respectively, an 'explosive' component of an exemplary training IED as an inert 105 millimeter shell 120 and an inert Rocket Propelled Grenade (RPG) 140. As used herein, inert refers to the fact that the shell 120 and RPG 140 will not explode. A cell phone 122 and wiring 124 are attached to the 105 millimeter shell 120 of FIG. 2A. The cell phone 122 and wiring 124 can provide a visual clue that the device is an (training) IED. As is well known, cell phones, door bell devices, and other such devices, can be attached to live IEDs to trigger an explosion of the IED.

Figure 3:
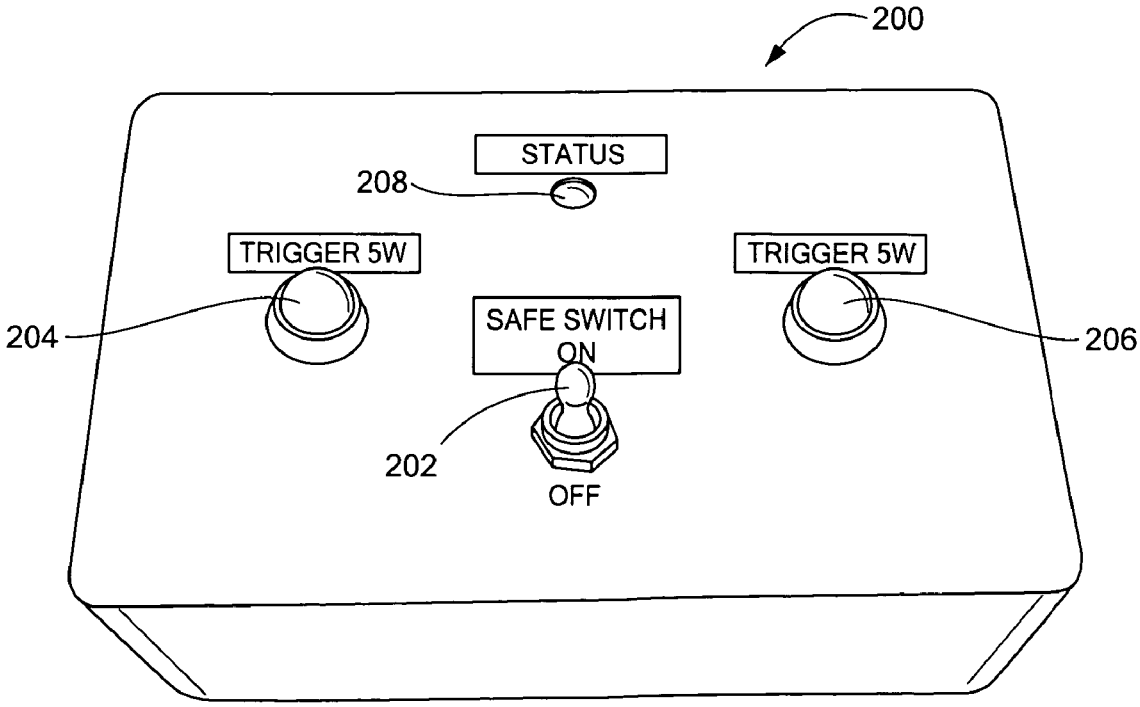
FIG. 3 is a depiction of an exemplary wired trigger box.

FIG. 3 shows a pictorial representation of an exemplary wired trigger box 200. As described more fully below, the trigger box 200 enables a user to arm the training IED. In one embodiment, the trigger box 200 includes a safe switch 202 and first and second trigger switches 204, 206. A status lamp 208 can also be provided indicating whether the system is ready to be triggered. In one embodiment, a trigger input is provided to the interface device assembly when the first and second trigger switches 204, 206 are pressed simultaneously.

Figure 4A:
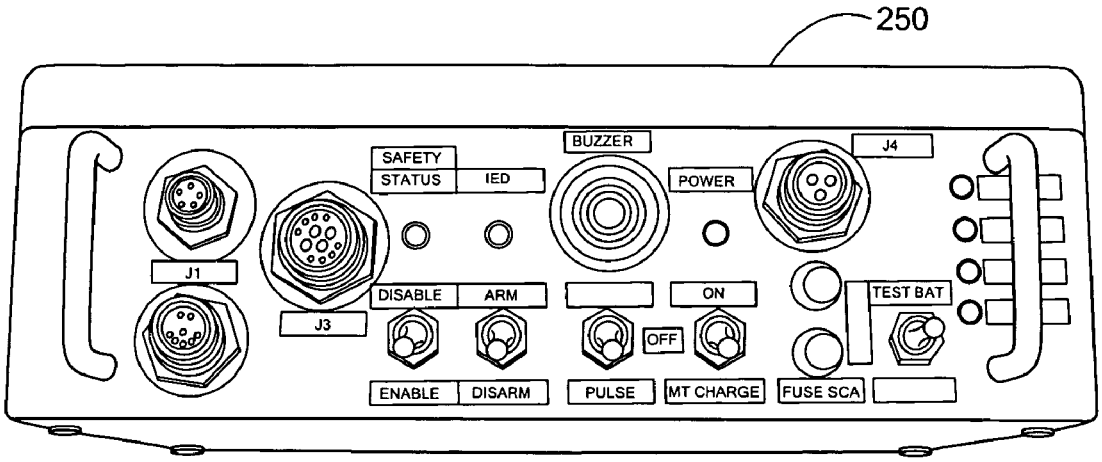
FIG. 4A is a front view of an exemplary interface device assembly.
Figure 4B:
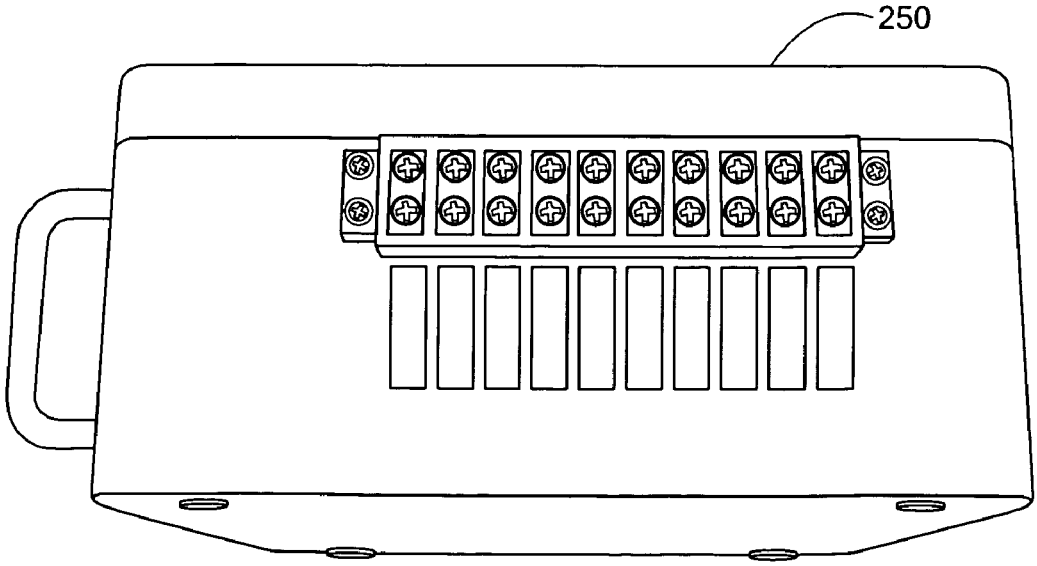
FIG. 4B is a rear view of an exemplary interface device assembly.

FIG. 4A shows a front view and FIG. 4B shows a rear view of an exemplary interface device assembly 250, which can correspond to the interface device assembly 102 of FIG. 1. The interface device assembly 250 includes, as shown in FIG. 4A, a series of status lamps, switches and connectors to control/monitor the training IED. As shown in FIG. 4B, the rear of the interface device assembly 250 can include a series of wire connectors for power, ground, and network communication. The interface device assembly 250 will be described further below.

The training IED can include various components to enhance device functionality and realism for the trainee. It will be appreciated that training is improved by providing the user with a more realistic experience.

Figure 5:
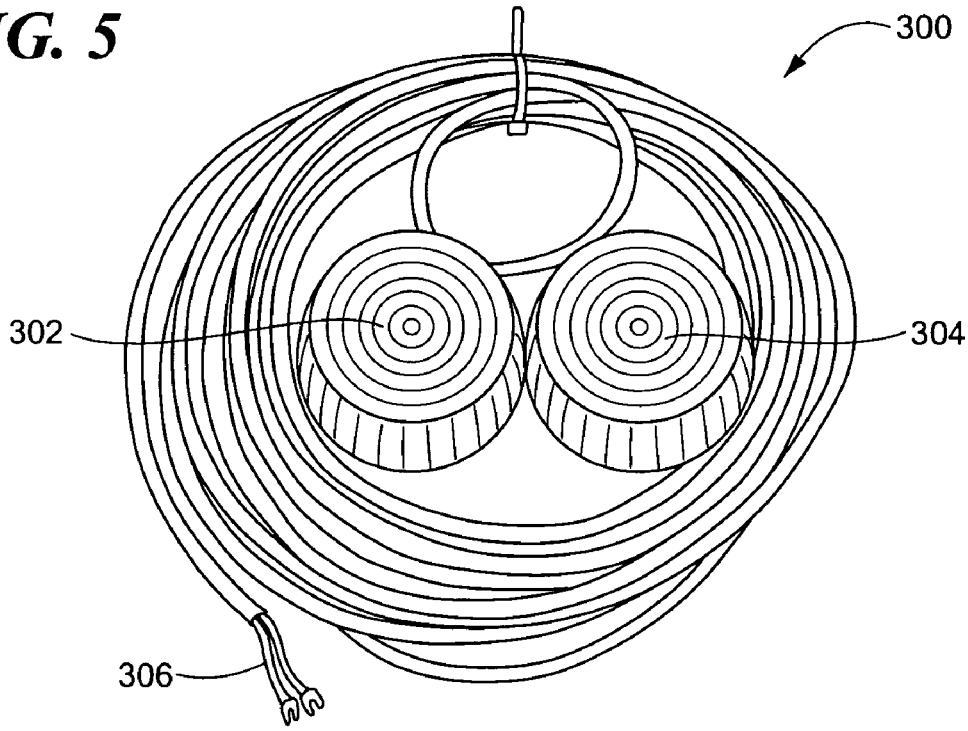
FIG. 5 is a depiction of an exemplary strobe assembly.

FIG. 5 shows an exemplary strobe assembly 300 having first and second lamps 302, 304. A connector 306 can be coupled to an interface device assembly, such as the interface device assembly 250 of FIGS. 4A and 4B. Upon activation, the strobe lamps are energized in indicate triggering of the training IED.

Figure 6:
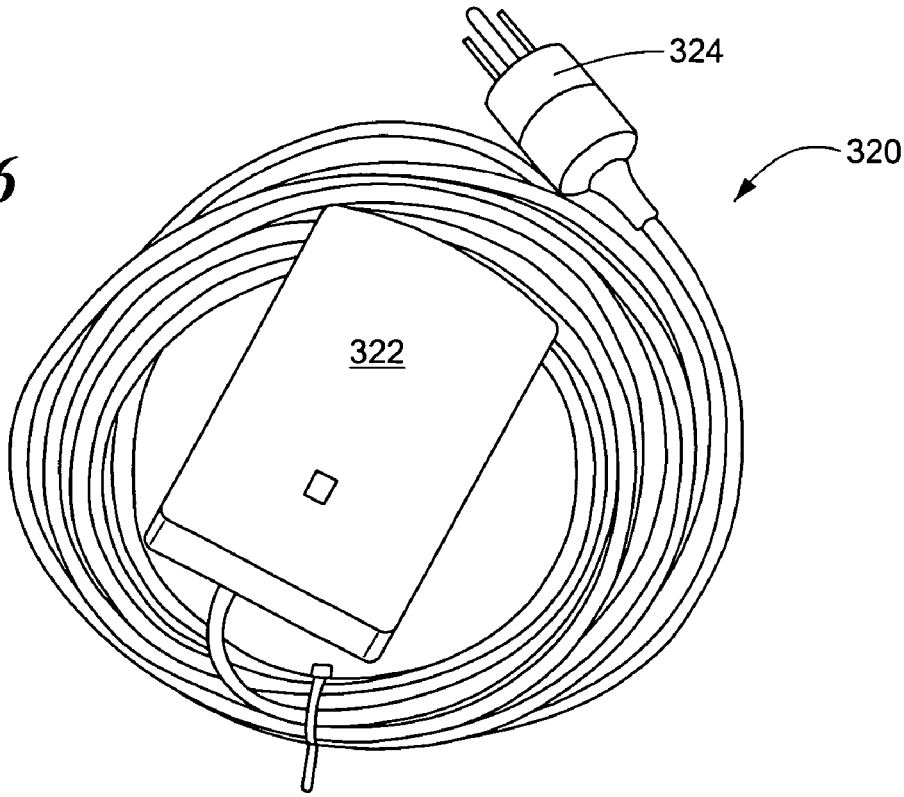
FIG. 6 is a depiction of an exemplary motion sensor assembly.

FIG. 6 shows an exemplary motion sensor assembly 320 having a motion sensor 322 and a connector 324 that can be coupled to the interface device assembly 250 of FIGS. 4A, 4B, for example. The motion sensor 322 can detect movement in proximity to the training IED. Based upon certain parameters, movement of a trainee near the training IED can result in triggering of the training IED. This may in turn result in activation of the strobe assembly 250 of FIG. 5.

Figure 7:
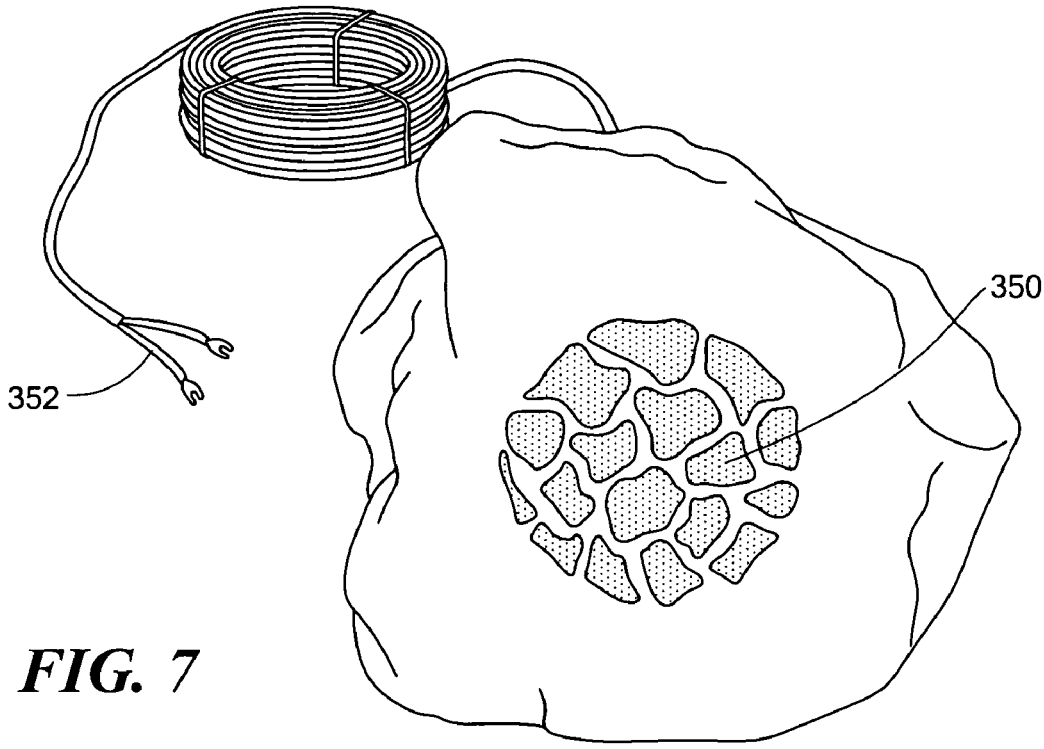
FIG. 7 is a depiction of a speaker.

FIG. 7 shows an exemplary speaker 350 fabricated to resemble a rock. It is understood that the speaker can have almost any size and can be configured to resemble almost any object. A connector 352 can be coupled to the interface device assembly. The speaker 350 generates sounds associated with triggering of the training of the IED.

Figure 8:
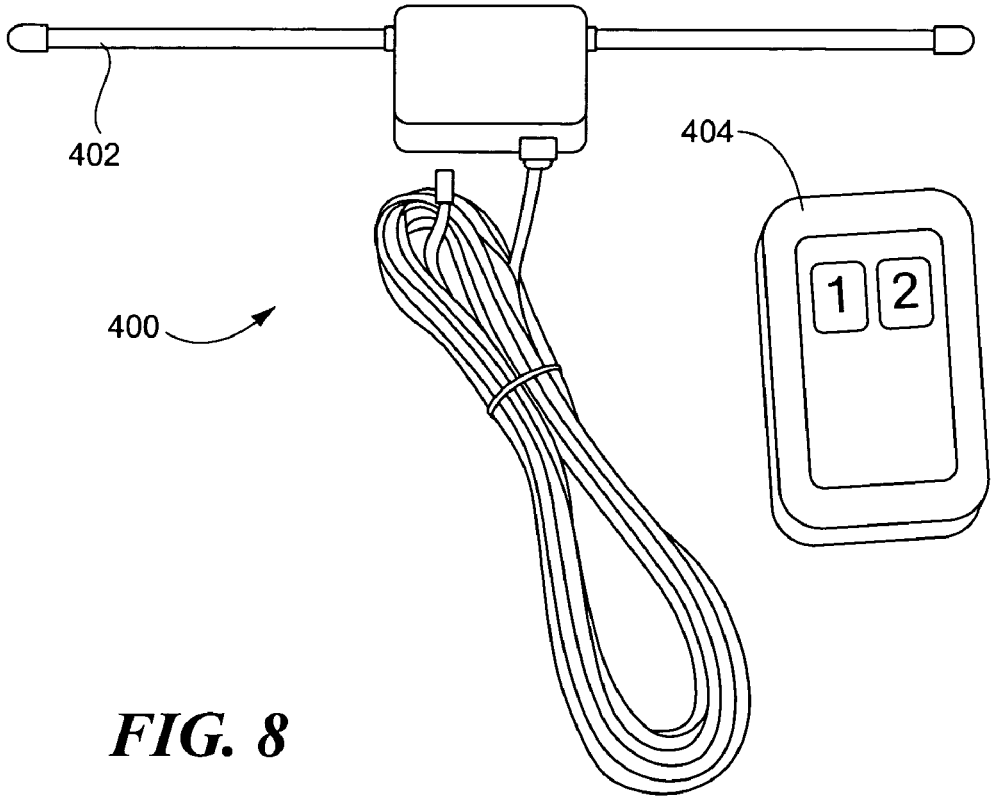
FIG. 8 is a depiction of an antenna and wireless remote.

FIG. 8 shows an exemplary antenna assembly 400 having an antenna 402 and wireless remote 404. The antenna 402 can be coupled to an explosive component, such as the 105 millimeter shell 120 of FIG. 2A, to provide a visual clue to a trainee. The wireless remote 404 can be used to trigger the training IED.

The training IED can include various pyrotechnic features to enhance the training experience. It is understood that pyrotechnic features can be real, e.g., include gunpowder, and/or simulated.

Figure 10:
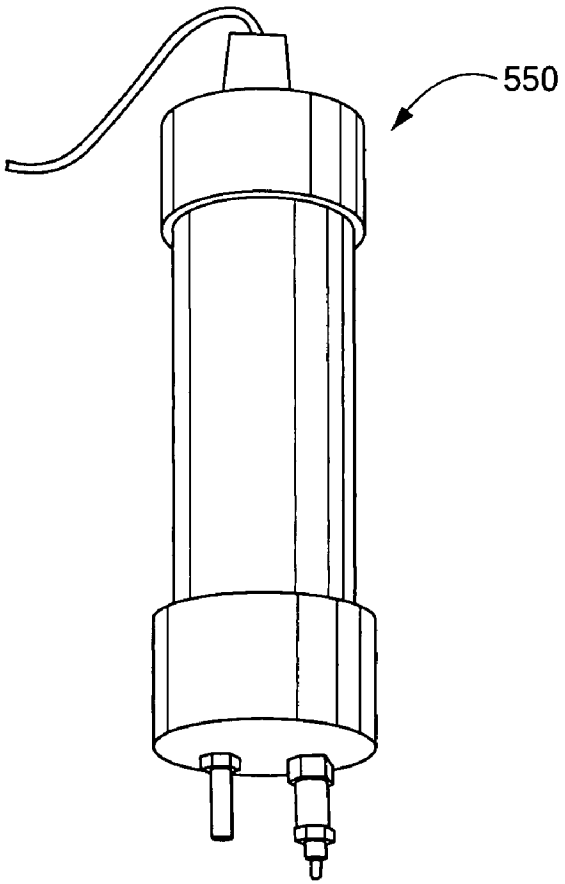
FIG. 10 is a depiction of a canister that can contain power under pressure that can be triggered to release the powder.
Figure 9:
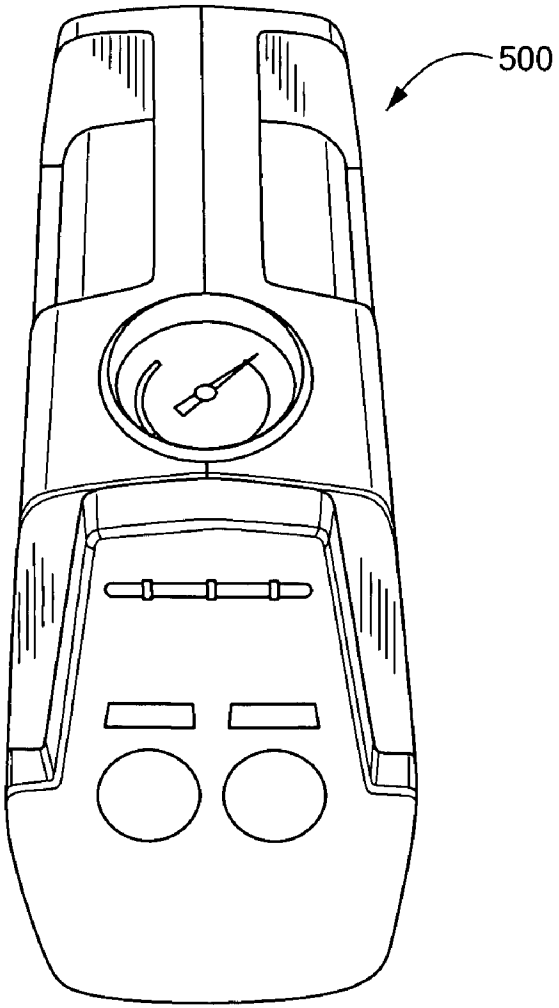
FIG. 9 is a depiction of a compressor.
Figure 11:
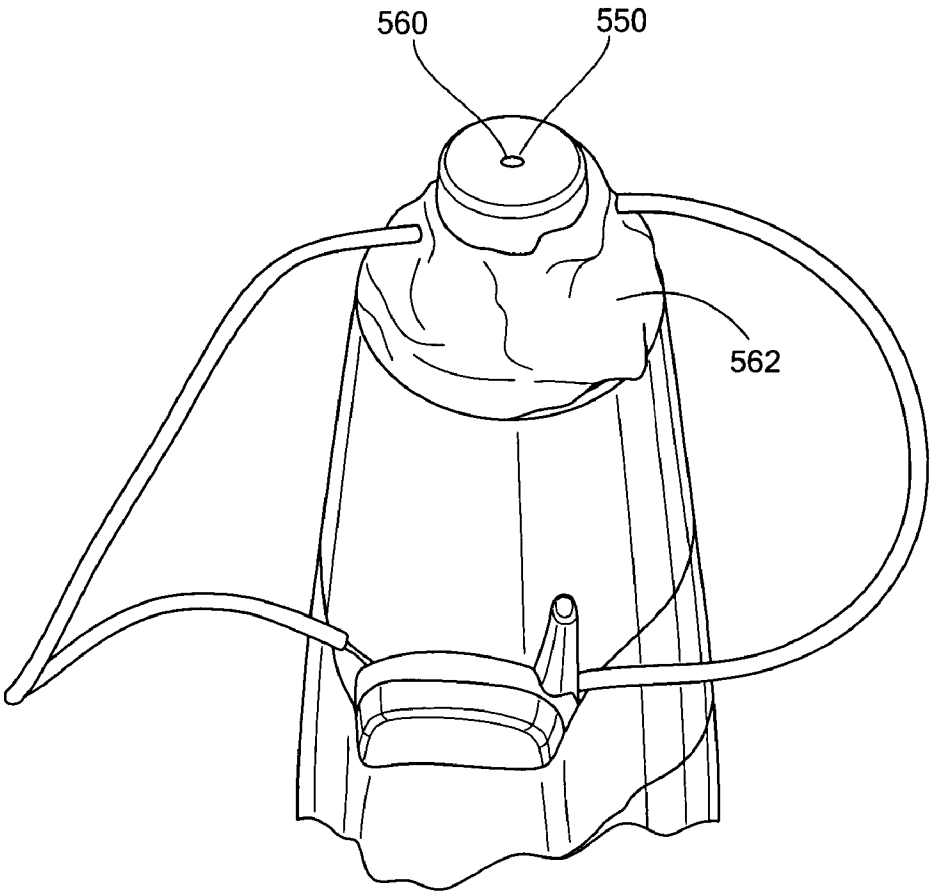
FIG. 11 is a depiction of a canister coupled to a round.

FIG. 9 shows an illustrative compressor 500 that can be used to pressure powder in a canister, such as the exemplary powder burst canister 550 of FIG. 10. FIG. 11 shows a burst canister 550 installed in a 105 mm round. The canister 550 includes an exhaust port 560 through which the pressurized powder can be discharged. In one embodiment, plumber's putty 562 is used to simulate C4 type explosive.

In another embodiment, the interface device assembly is coupled to a conventional M-80 TOW blast simulator (approximately ¼ stick of dynamite). The interface device assembly can be coupled to various simulation systems, such as an Anti Tank Weapons Engagement Simulation System (ATWESS). The ATWESS, when triggered, provides a flash and smoke signature that replicates the launching of shoulder fired munitions, e.g., Rocket Propelled Grenade (RPG), Viper, Stinger missile, etc. Another simulator system is the Main Gun System Simulator (MGSS), which is normally mounted on armored vehicles, simulating the firing of a main gun by electronically igniting a pyrotechnic cartridge. Another simulator system is the Direct Indirect Fire Cue (DIFCUE), which is normally mounted on armored vehicles, to simulate incoming artillery fire by electronically igniting a pyrotechnic cartridge.

Referring again to FIG. 4A, in one embodiment the interface device assembly 250 includes a first input connector 252 for the wired trigger box 200 of FIG. 4, for example. A second input connector 254 provides an input for the motion sensor 320 of FIG. 6. A first output connector 256 can be coupled to one or more external devices, such as, for example, the strobe assembly 300 of FIG. 5, the speaker 350 of FIG. 7, and/or the burst canister 550 of FIGS. 10 and 11.

A first switch 258 enables and disables external triggers, a second switch 260 arms and disarms the system, and a third switch 262 selects pulses or continuous sound from the speaker. An audio alarm 264, which can be provided as a piezo-type alarm, can indicate when the system has been triggered.

The interface device assembly 250 can also include various status indicators. In the illustrated embodiment, a system ready indicator 266 provides external trigger safety status and a system status indicator 268 provides an indication of system readiness. A power on indicator 270 indicates whether power is one or off.

A battery charger input connector 272 enables charging of a battery under the control of a battery charge on/off switch 274. Battery level indicators 276 provide an indication of the battery charge level. Fuses 278 limit current flow to prevent damage to the electrical components in the interface device assembly.

Referring again to FIG. 4B, the interface device assembly 250 wire connections can be used to couple the various devices in the system in addition to power and ground. A first connector 280 can be coupled to the powder burst canister 250 of FIGS. 10 and 11 for example. A second connector 282 can be coupled to the strobe assembly 300 of FIG. 5. A third connector 284 can be coupled to the speaker 350 of FIG. 7.

In operation, the training system for IEDs can provide various operating modes and have certain safety features to enhance the overall IED training experience. For example, with the exception of the battery power indicators, the interface device assembly 250 (FIGS. 4A, 4B) will not provide output triggers if any of the front panel display indicators (shown as LEDs) are red. This also applies to the red indicator (LED) on the wired remote. For the wireless remote 400 (FIG. 8), pushing either button "1" or "2" will cause the red indicator (LED) on the assembly to light and the unit will transmit the appropriate RF coded frequency. Pushing button "1" will trigger the system. For normal operation with the wireless remote, pushing button "2" will cause the IED indicator on the interface device assembly 250 to flash for 3 seconds, the alarm to sound for three seconds and the speaker to generate sounds.

When all LEDs are green on the interface device assembly 250 and the wired trigger box 200 of FIG. 3, both buttons on the wired trigger box are pressed at the same time to trigger an event. After initial setup, the motion sensor 322 will cause the system to trigger immediately after motion is detected.

Figure 12:
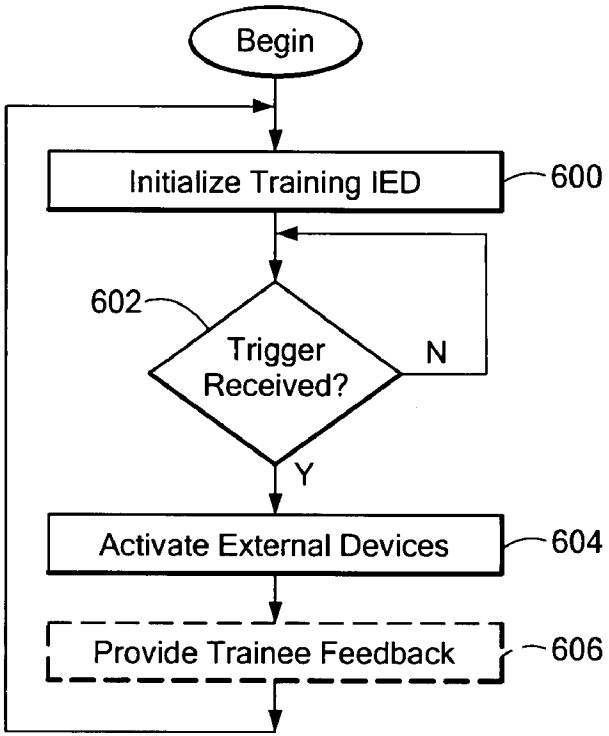
FIG. 12 is a flow diagram showing an exemplary sequence of steps to operate a training IED system.

FIG. 12 shows an exemplary sequence of steps for an IED training device in accordance with the present invention. In step 600, the IED training system is initialized. The triggers are armed and external triggers enabled. The user should verify that status indicators are a go, e.g., LEDs are green. The user then waits for the system to be triggered in step 602. The system can be activated by trigger inputs from the motion sensor, for example, if a trainee is too close to the training IED system. The motion sensor may be placed near an inert explosive component, which can resemble a shell or RPG, having a canister that can discharge powder in the event of a trigger. The system can also be activated by a user, for example by depressing simultaneously, the two trigger switches on the wired trigger box.

In step 604, the system activates various external devices, including, for example, one or more of the strobe lights, the speaker, and the powder canister. These devices provide an indication to the trainee that the simulated IED has been triggered. In optional step 606, the trainer can provide feedback to the trainee based upon performance in conjunction with the training IED. The system can then be reset for the next training exercise in step 600.

Figure 13:
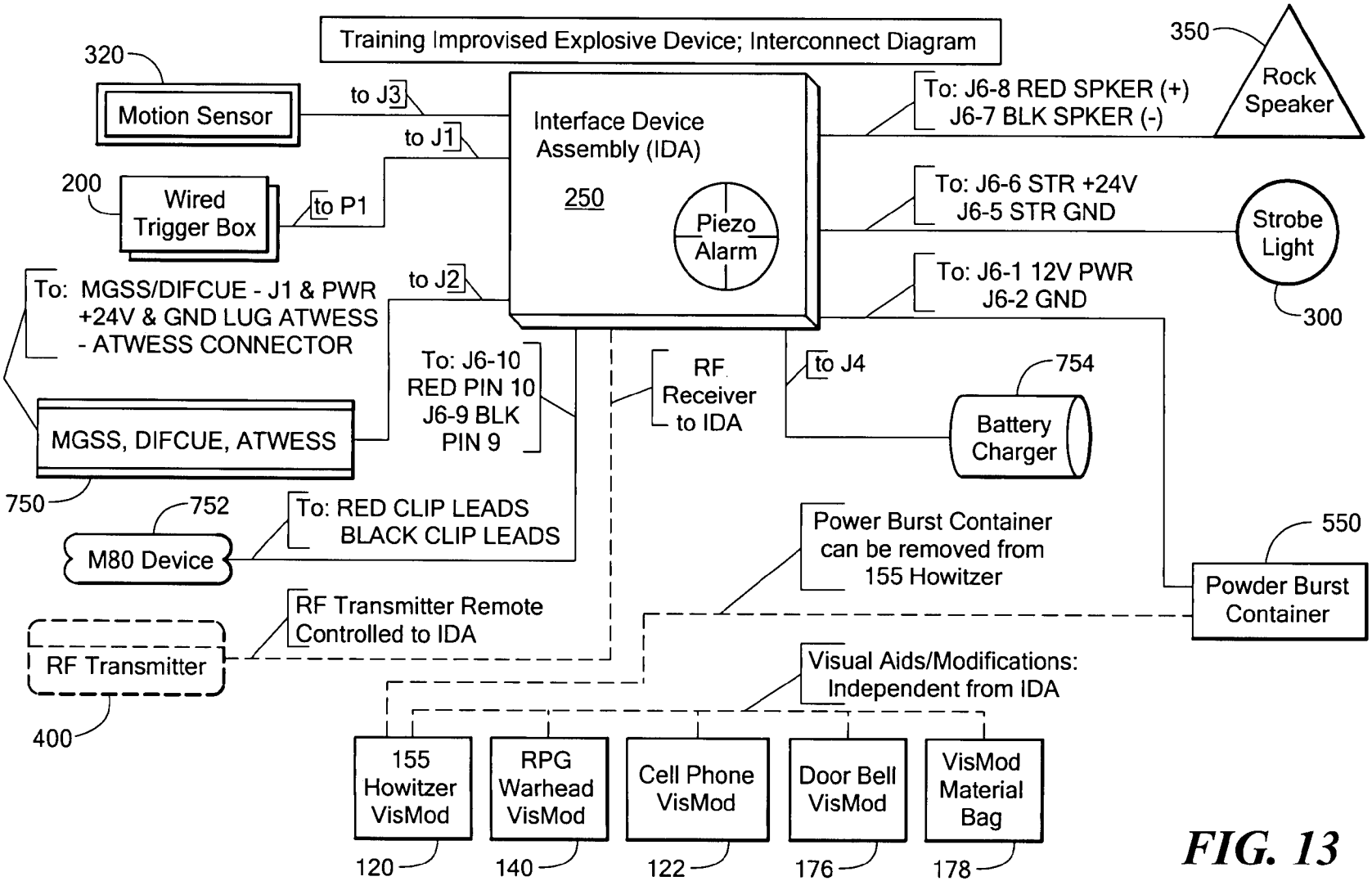
FIG. 13 is a schematic diagram of an exemplary training IED in accordance with the present invention.

FIG. 13 shows an exemplary interconnection diagram 700 for a training IED system in accordance with the present invention. It is understood that a training IED system may not include all of the illustrated components. The interface device assembly 250 is coupled to the components described above including a motion sensor 320 (FIG. 6), a wired trigger box 200 (FIG. 3), a speaker 350 (FIG. 7), a strobe light 300 (FIG. 5), a (wireless) RF transmitter 400 (FIG. 8), and a powder burst container 550 (FIG. 11). As noted above, a MGSS, DIFCUE, ATWESS module 750 can be coupled to the interface device assembly 250. An M80 device 752 can also be coupled to the interface device assembly. As mentioned above, the system can include a battery charger 754.

The training IED system can also include visual cues including a howitzer shell 120 (FIG. 2A), an RPG warhead 140 (FIG. 2B), a cell phone 122, a door bell, 176, and a material bag 178.

Figure 14:
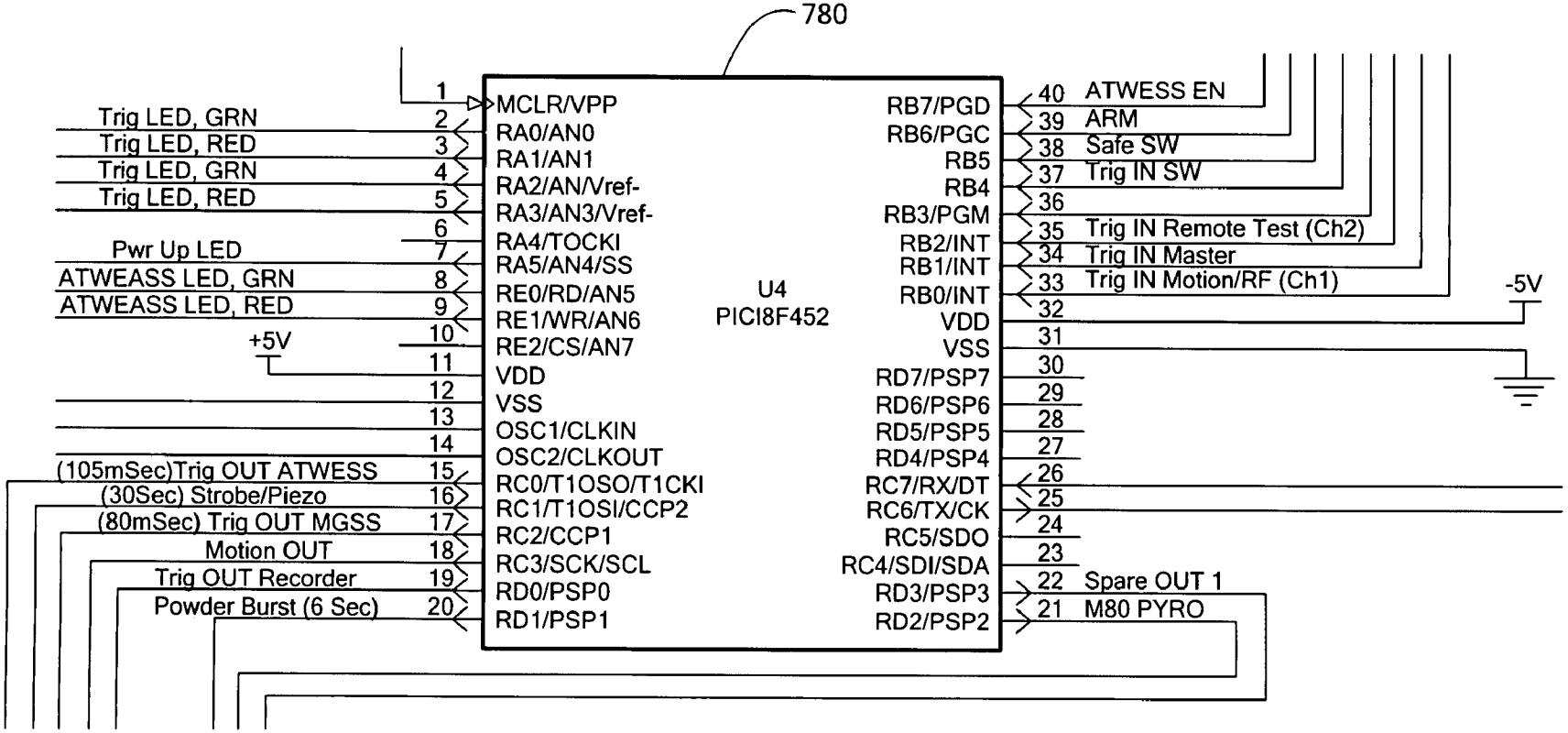
FIG. 14 is a schematic diagram of an exemplary interface device assembly that can form a part of a training IED system in accordance with the present invention.
Figure 15:
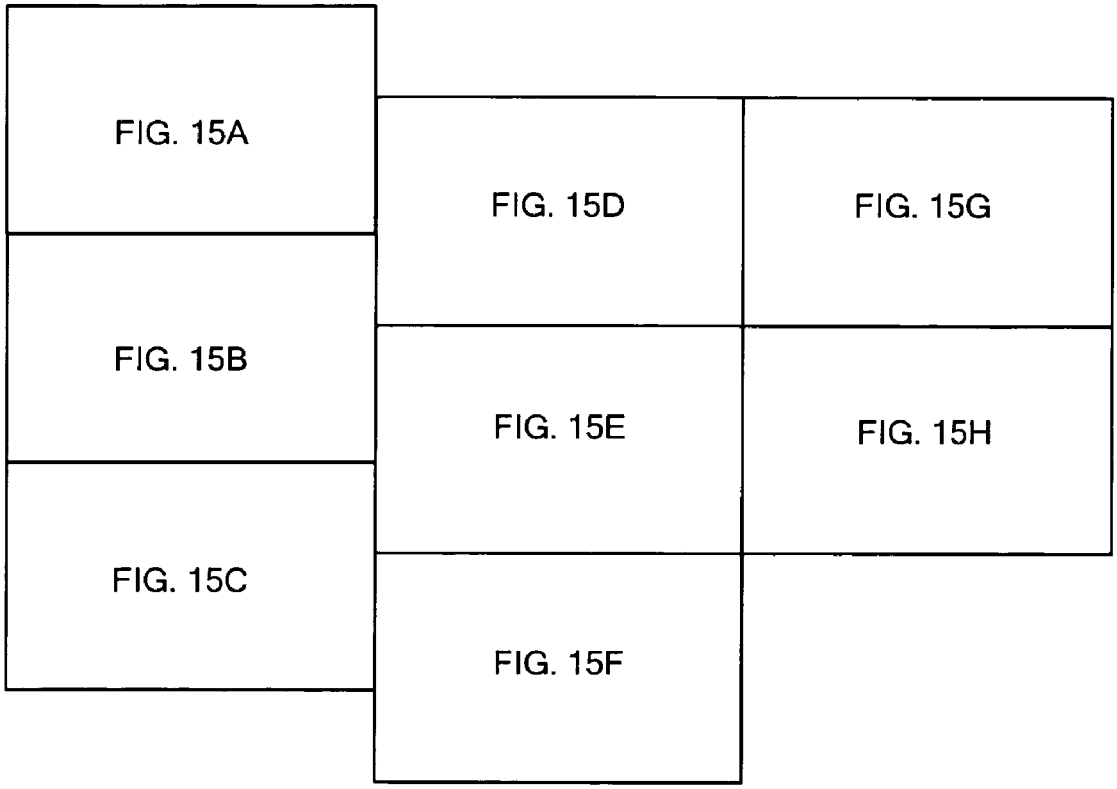
FIGS. 15 and 15A-15H are schematic diagrams of a portion of an exemplary training IED system in accordance with the present invention.
Figure 15A:
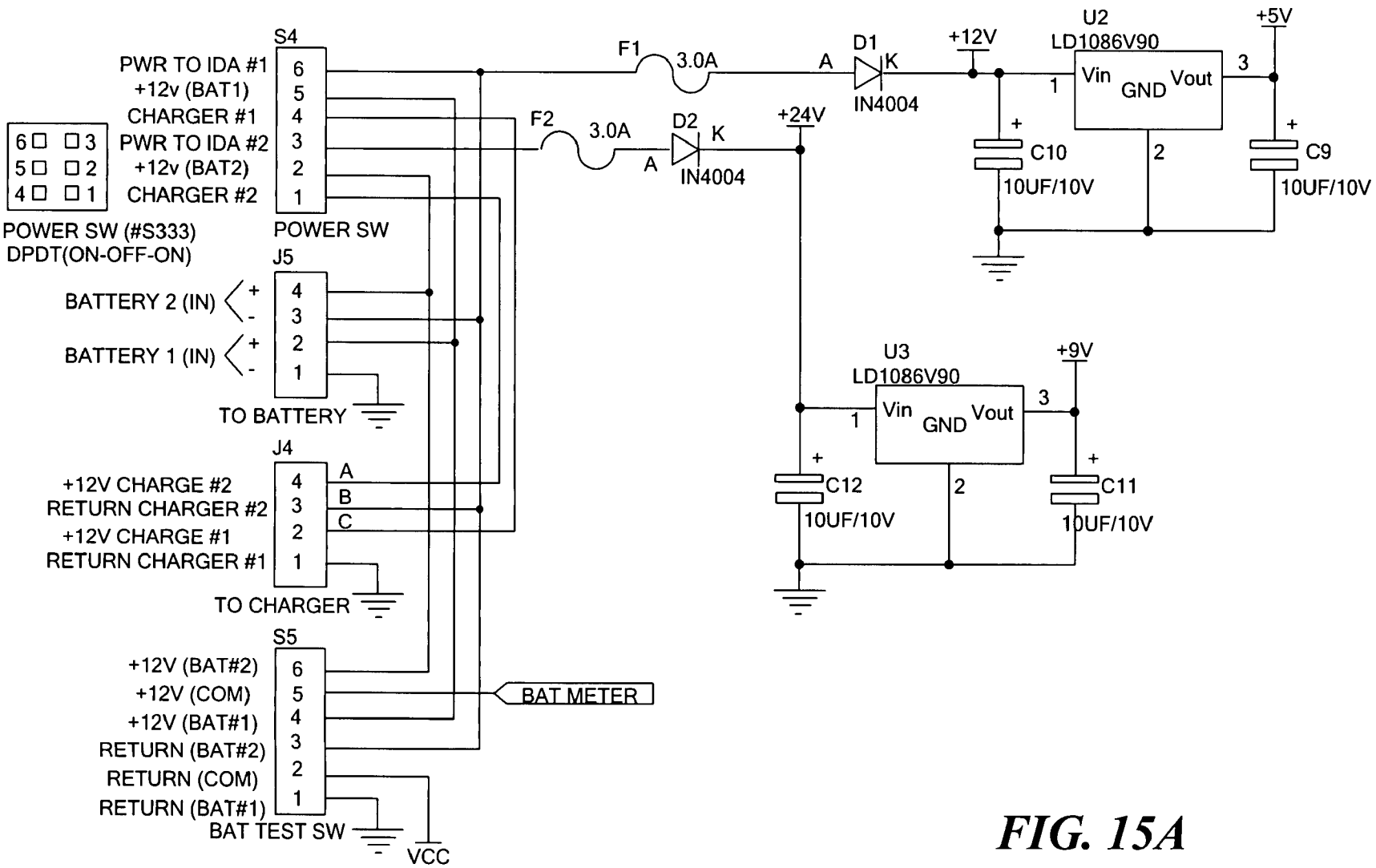
Figure 15B:
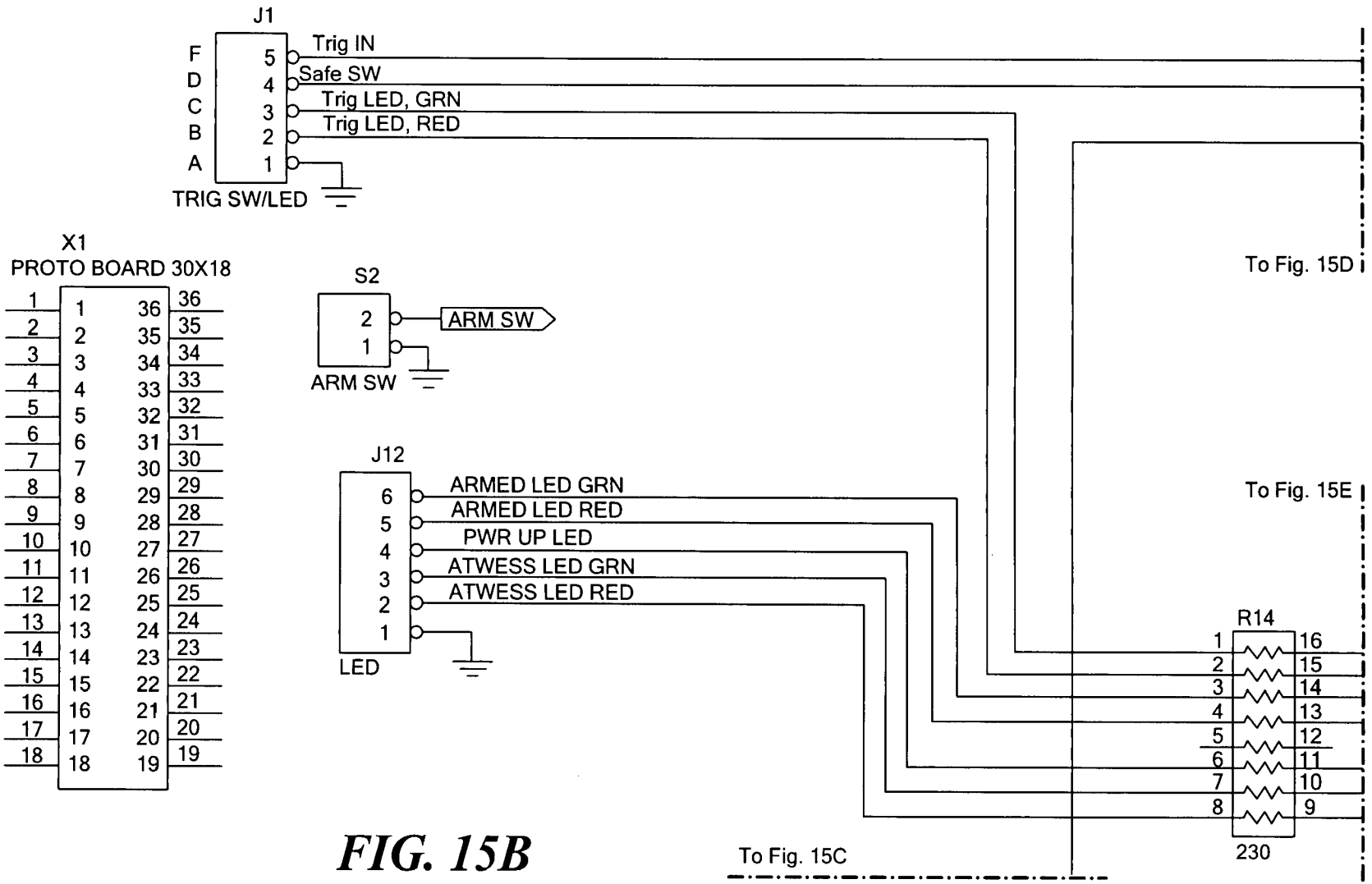
Figure 15C:
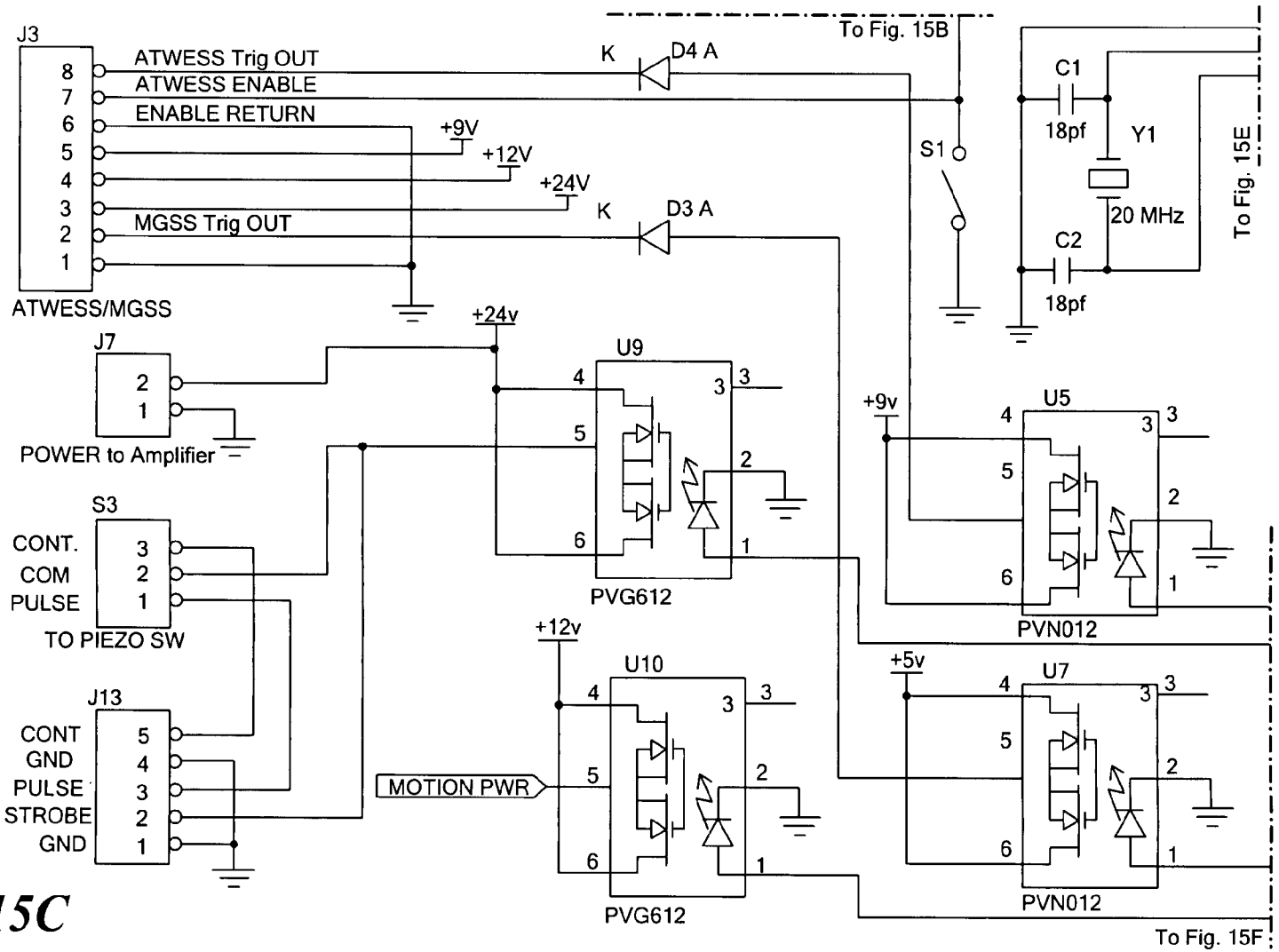
Figure 15D:
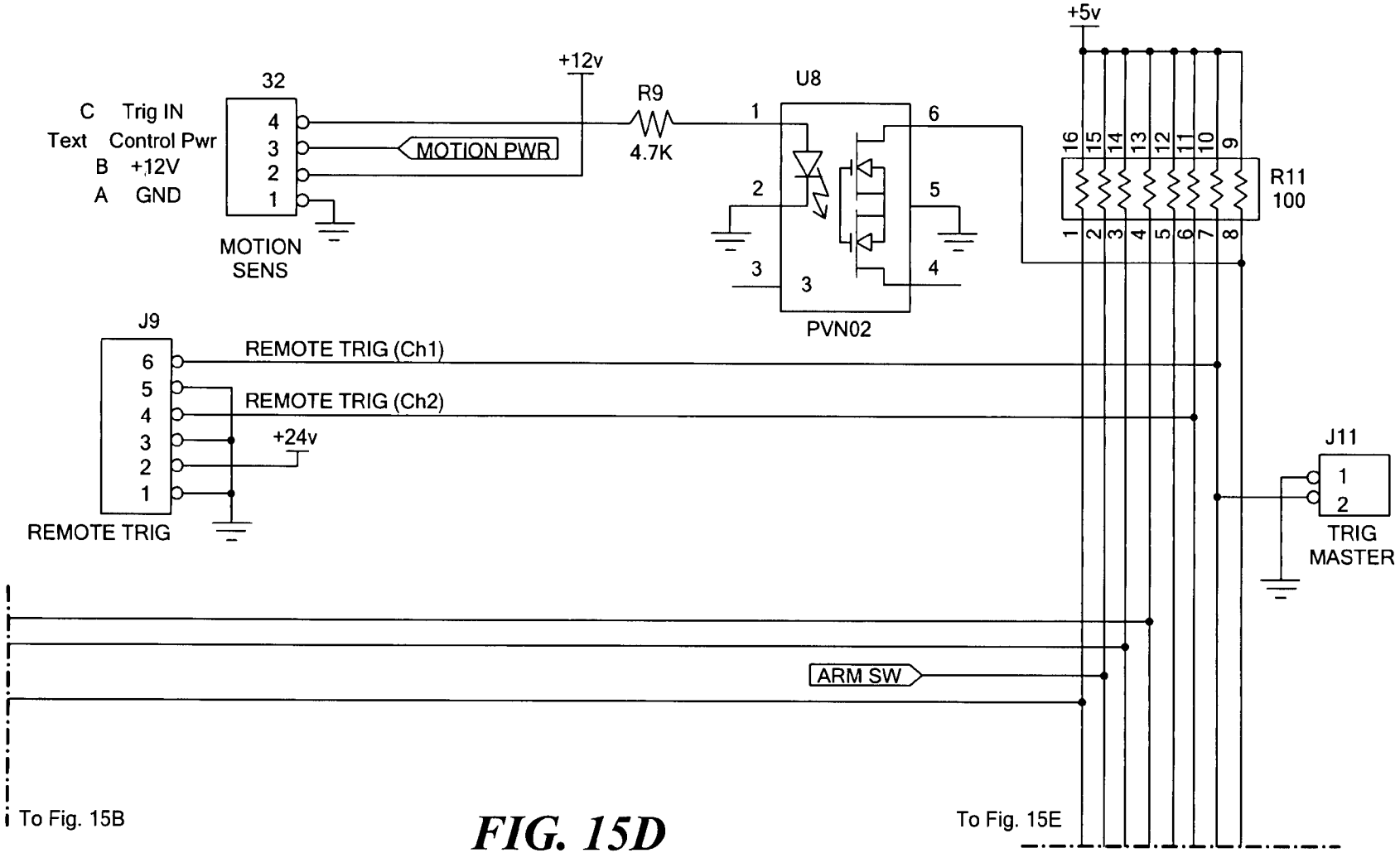
Figure 15E:
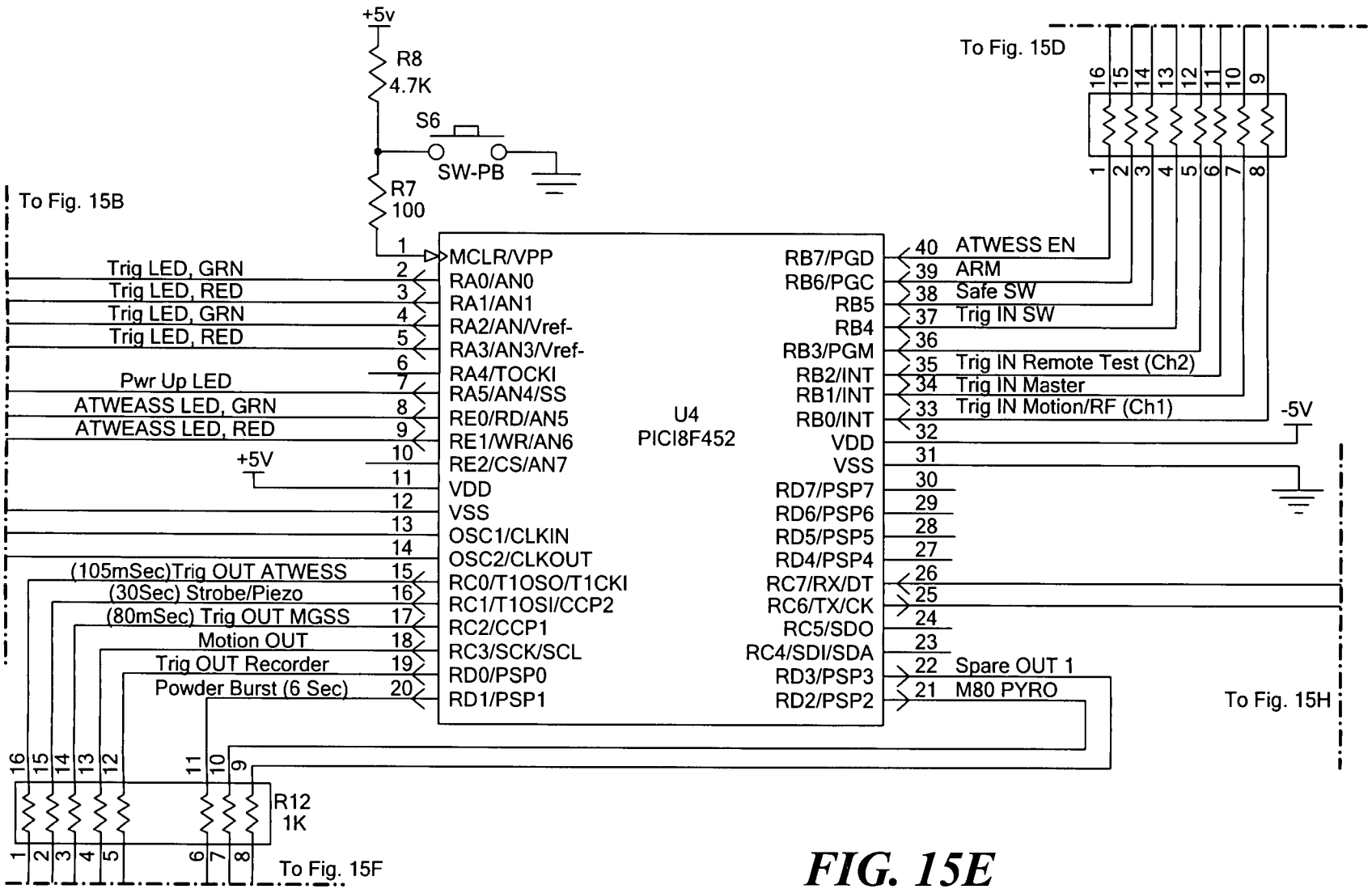
Figure 15F:
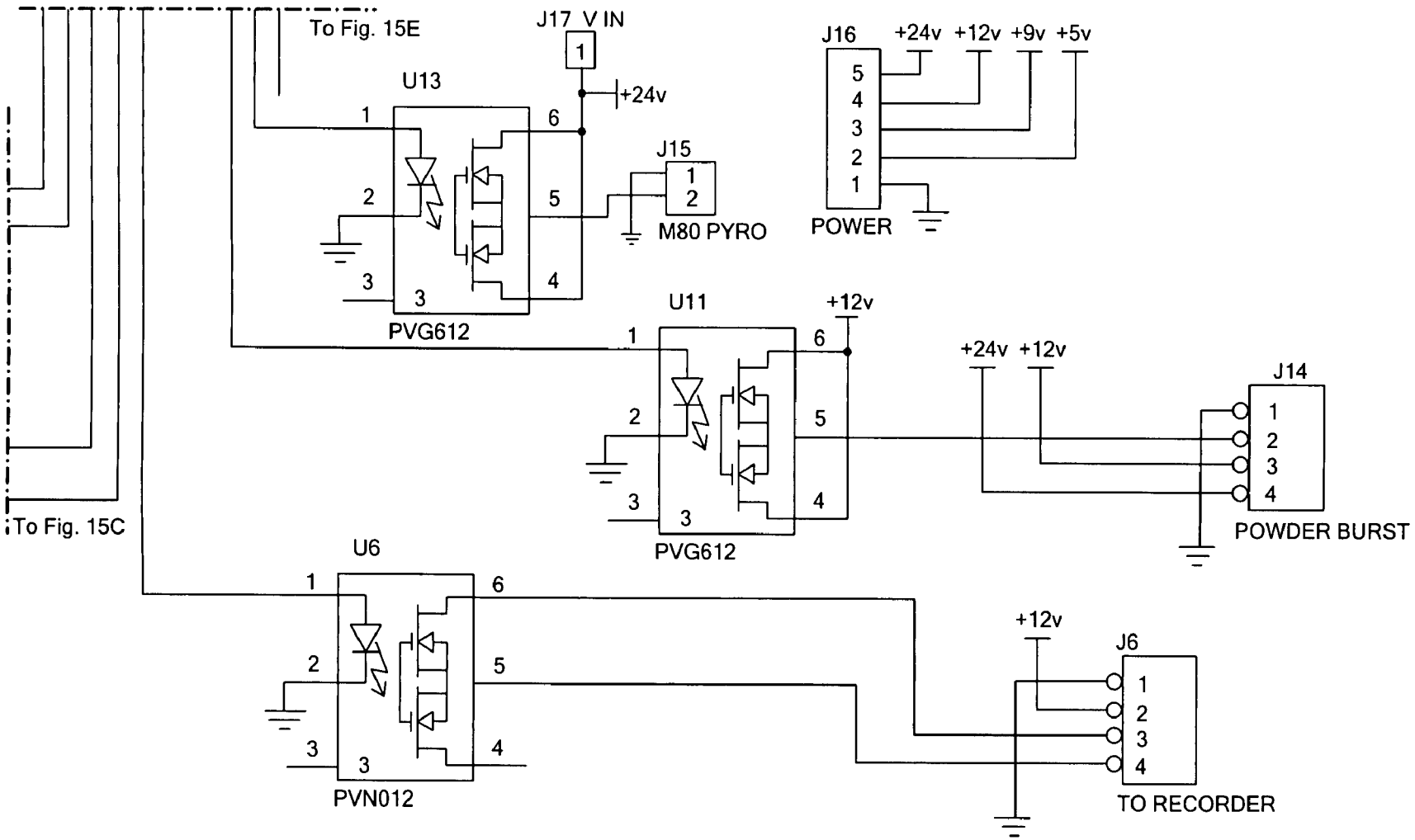
Figure 15G:
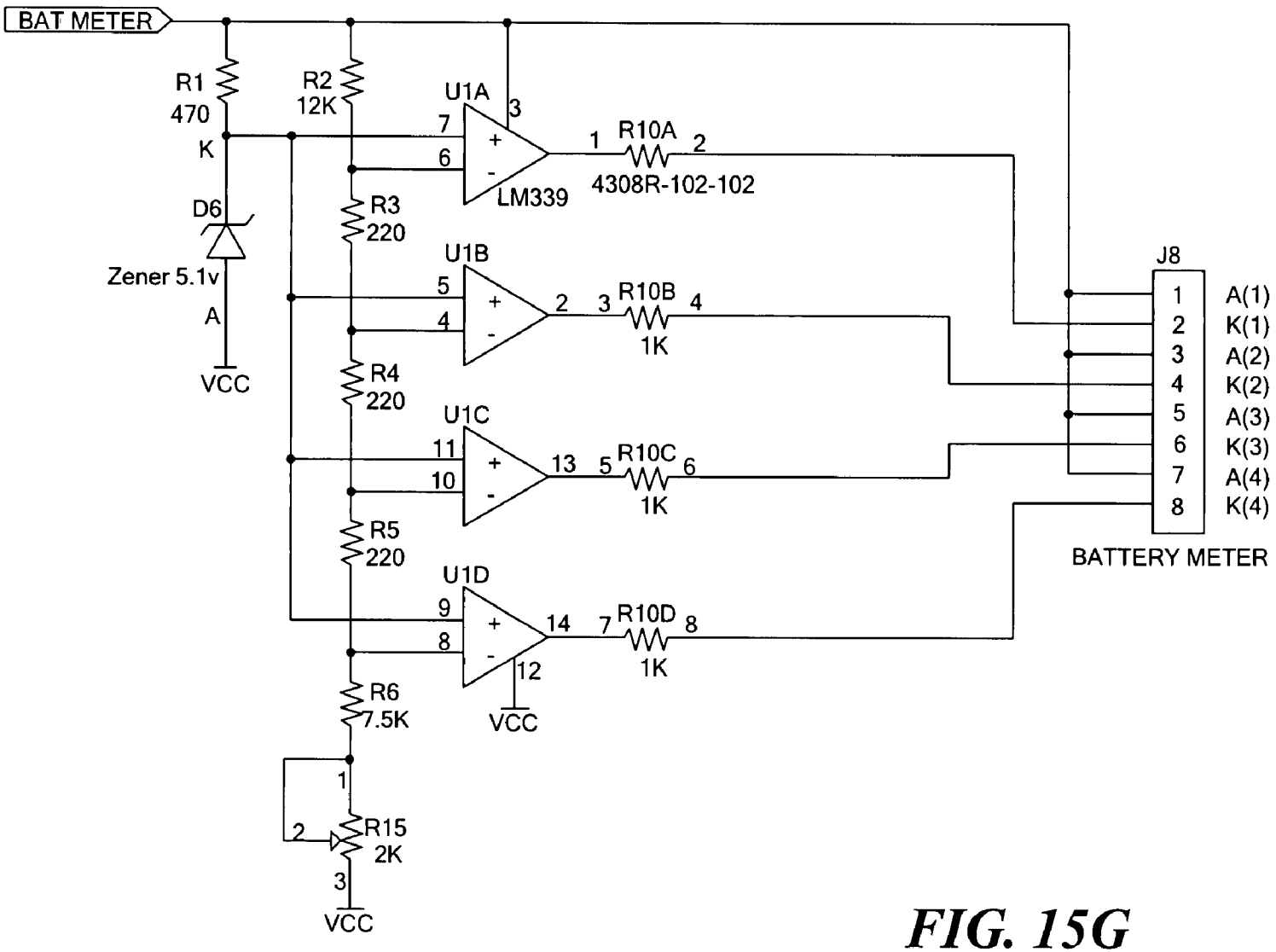
Figure 15H:
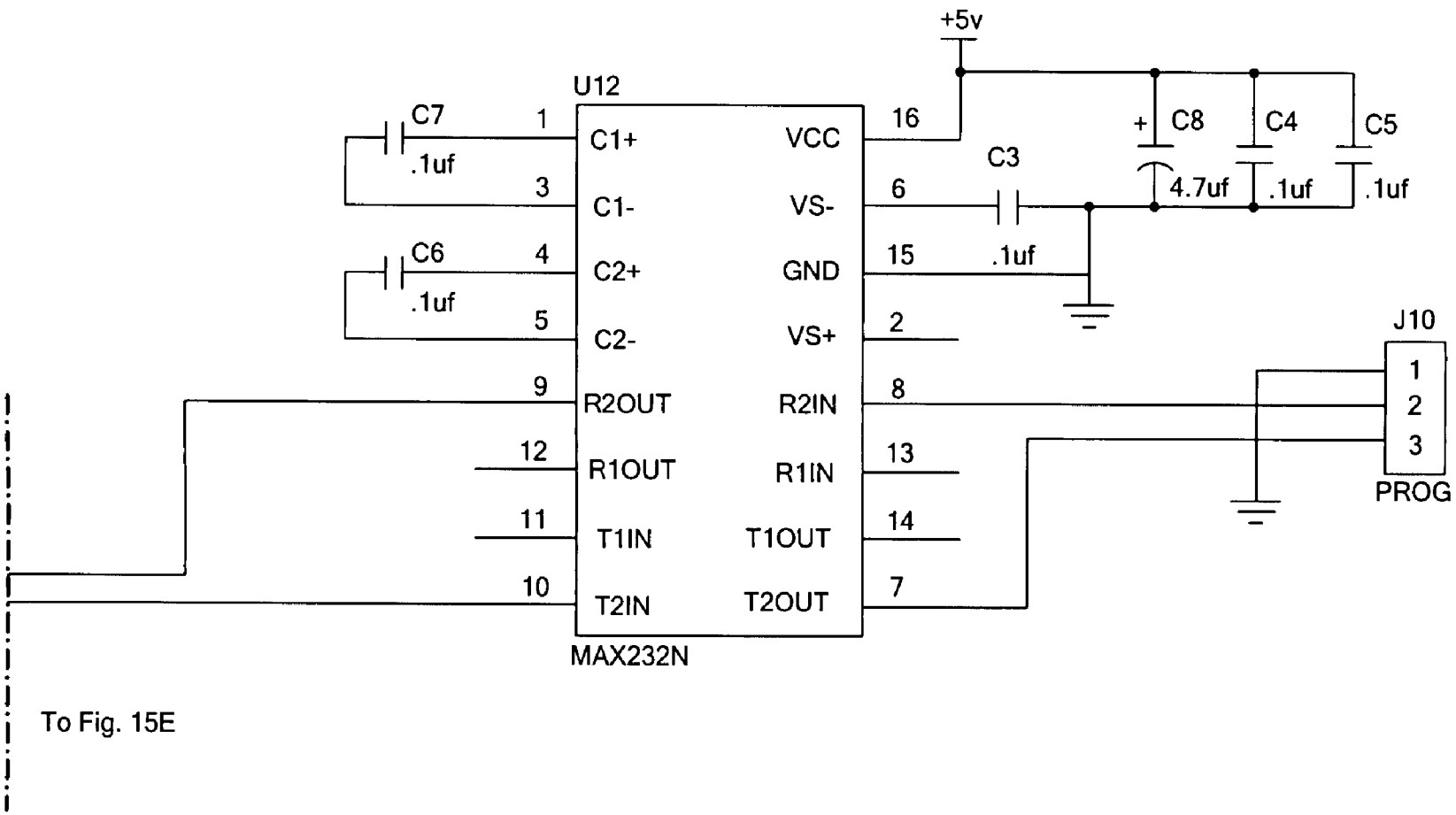

FIG. 14 shows an exemplary schematic diagram of an interface device assembly 250 having a microcontroller 780 controlling the various components described above. FIG. 15 shows an illustrative schematic diagram of the connections to the interface device assembly 250.

While an exemplary microcontroller circuit diagram is shown, it will be readily appreciated that a wide variety of alternative circuit implementations are possible with different partitions between hardware and software.

The present invention provides a training device for IEDs to teach service personnel how to identify IEDs in the field. By enhancing the ability of trainees to locate IEDs, lives will be saved and injuries reduced.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A training system for an improvised explosive device (IED), comprising:

an inert explosive component configured to resemble a real improvised explosive device;

visual cues attached to the inert explosive component, wherein the visual cues are indicative of an improvised explosive device, the visual cues including a cell phone and wiring;

an explosion simulation device coupled to the inert explosive component; and an interface device assembly coupled to the explosion simulation device, which can be activated upon triggering of the system.

2. The system according to claim 1, wherein the explosion simulation device includes a canister to hold powder that can be discharged.

3. The system according to claim 1, wherein the explosion simulation device includes a pyrotechnic device.

4. The system according to claim 1, further including an audio device coupled to the interface device assembly to make sound upon triggering of the system.

5. The system according to claim 1, further including a visual device coupled to the interface device assembly to generate visual effects upon triggering of the system.

6. The system according to claim 1, further including a trigger device coupled to the interface device assembly to enable a user to trigger the system.

7. The system according to claim 6, wherein the trigger device includes a wired and/or wireless device.

8. The system according to claim 1, further including a motion sensor to trigger to the system.

* * * * *

UNITED STATES PATENT AND TRADEMARK OFFICE

CERTIFICATE OF CORRECTION

PATENT NO. : 7,507,089 B2
APPLICATION NO. : 11/182495
DATED : March 24, 2009
INVENTOR(S) : Giles D. Jones et al.

It is certified that error appears in the above-identified patent and that said Letters Patent is hereby corrected as shown below:

Col. 2, line 9, delete “speaker;” and replace with -- speaker. --.

Col. 2, line 18, delete “power” and replace with -- powder --.

Col. 2, line 45, delete “power” and replace with -- powder --.

Col. 3, line 4, delete “clues.” and replace with -- cues. --.

Col. 3, line 11, delete “clue” and replace with -- cue --.

Col. 3, line 61, delete “clue” and replace with -- cue --.

Col. 5, line 48, delete “door bell, 176,” and replace with -- door bell 176, --.

Signed and Sealed this

Twenty-third Day of June, 2009

JOHN DOLL
*Acting Director of the United States Patent and Trademark Office*